US006789709B2

(12) United States Patent
Owens

(10) Patent No.: US 6,789,709 B2
(45) Date of Patent: Sep. 14, 2004

(54) FEATHER CURLER

(75) Inventor: Danny Ray Owens, Lubbock, TX (US)

(73) Assignee: Van Dyke Taxidermy Supply Co., Woonsocket, SD (US)

( * ) Notice: Subject to any disclaimer, the term of this patent is extended or adjusted under 35 U.S.C. 154(b) by 0 days.

(21) Appl. No.: 10/193,078

(22) Filed: Jul. 9, 2002

(65) Prior Publication Data

US 2004/0007602 A1 Jan. 15, 2004

(51) Int. Cl.[7] ..... A41H 43/00
(52) U.S. Cl. ..... 223/47
(58) Field of Search ..... 223/47; 132/217

(56) References Cited

U.S. PATENT DOCUMENTS 1,951,130 A * 3/1934 Cohn et al. ..... 132/217
1,987,931 A * 1/1935 Goodman ..... 132/217
5,307,826 A * 5/1994 Iosilevich ..... 132/218

* cited by examiner

*Primary Examiner*—John J. Calvert
*Assistant Examiner*—James G Smith
(74) *Attorney, Agent, or Firm*—Bachman & LaPointe, P.C.

(57) ABSTRACT

The present invention relates to a device for curling feathers on a bird. The device comprises a base member having a convex surface and a mating member having a concave surface. The base member and the mating member define a space between the convex surface and the concave surface into which a feather to be curled may be placed. The base member and the mating member are configured so as to be squeezable so that the concave surface and the convex surface may be placed into contact with the feather to effect curling thereof. A method for using the curling device is also described.

11 Claims, 2 Drawing Sheets

FEATHER CURLER

BACKGROUND OF THE INVENTION

The present invention relates to a device for curling feathers and to a method of using the device.

Taxidermists often wish to make birds to be mounted as realistic as possible. To this end, it is desirable to curl the feathers of the bird. In the past, this has been very difficult to do.

SUMMARY OF THE INVENTION

Accordingly, it is an object of the present invention to provide a device for curling feathers.

It is a further object of the present invention to provide a device as above which is simple in construction and easy to use.

It is yet a further object of the present invention to provide an improved method for curling feathers.

The foregoing objects are attained by the device and the method of the present invention.

In accordance with the present invention, a device for curling feathers comprises a base member having a convex surface and a mating member having a concave surface. The base member and the mating member define a space between the convex surface and the concave surface into which a feather to be curled may be placed. Further, the base member and the mating member are configured to be squeezable so that the convex and concave surface can be brought into contact with the feather to effect curling of the feather.

A method for curling a feather comprises the steps of providing a curling device having a base member with a convex surface and a mating member with a concave surface, inserting a feather to be curled into a space between the convex surface and the concave surface, and curling the feather by squeezing the base member and the mating member together and pulling the curling device along a shaft of the feather so as to break the spine of the feather shaft and to bend the feather.

Other details of the feather curler of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
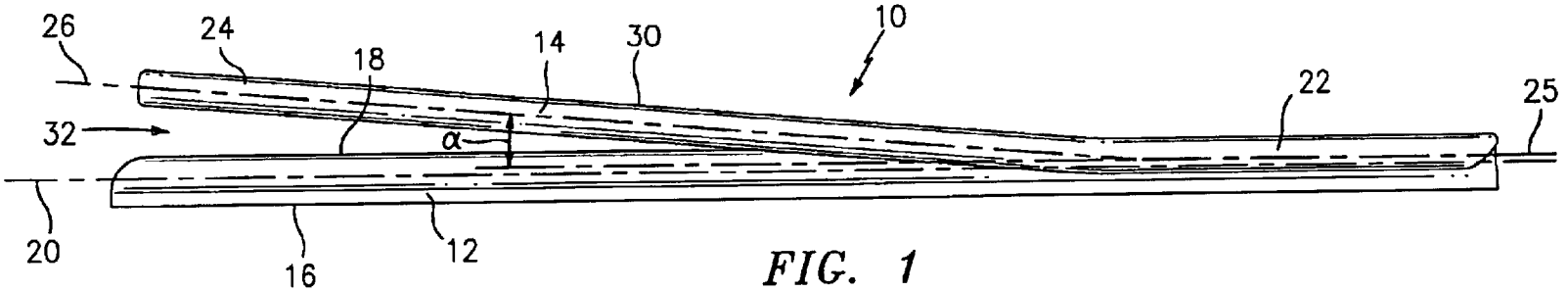
FIG. 1 is a side view of a feather curler in accordance with the present invention.

Referring now to the drawings, FIGS. 1–4 illustrate a feather curler 10 for curling feathers on birds. The feather curler 10 has a base member 12 and a mating member 14 joined thereto. Preferably, both the base member 12 and the mating member 14 are formed from a plastic material.

Figure 3:
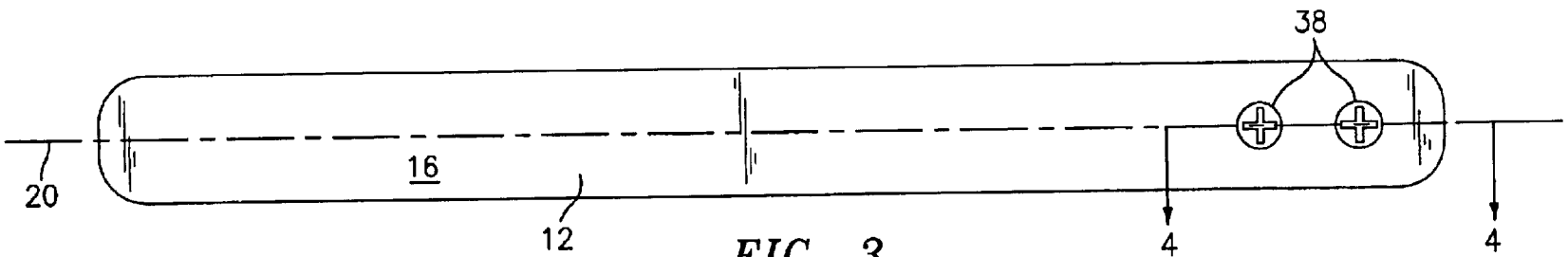
FIG. 3 is a bottom view of a base member of the feather curler of FIG. 1.
Figure 2:
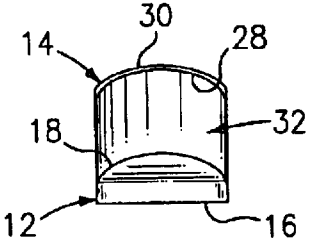
FIG. 2 is an end view of the feather curler of FIG. 1.

As can be seen from FIGS. 2 and 3, the base member 12 has a substantially planar surface 16 and a convex surface 18. The base member 12 also has a longitudinal axis 20.

The mating member 14 has a first section 22 which extends along an axis 25 which is parallel to the longitudinal axis 20 and a second section 24 which extends along an axis 26 at an angle $\alpha$ with respect to the axis 25 and to the longitudinal axis 20. Each of the sections 22 and 24 have an inner concave surface 28 and an outer concave surface 30. The inner concave surface 28 in the section 24 forms a space 32 with the convex surface 18 of the base member 12 into which a feather to be curled can be placed. The outer concave surface 30 facilitates the ability of a user to grasp and use the curler 10.

Figure 4:
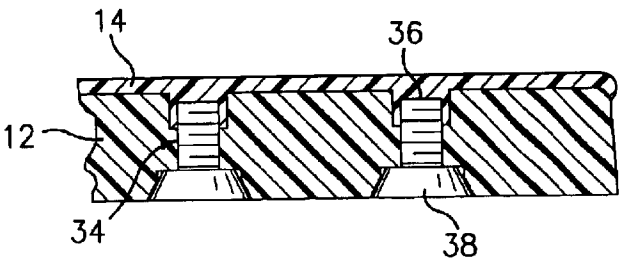
FIG. 4 is a sectional view of a portion of the feather curler of FIG. 1.

Referring now to FIG. 4, the base member 12 is provided with one or more apertures 34. The mating member section 14 has one or more threaded bores 36 which align with the apertures 34. One or more threaded fasteners 38 are used to join the base member 12 and the mating member 14. Each threaded fastener 38 passes through a respective aperture 34 into a respective bore 36.

Figure 5:
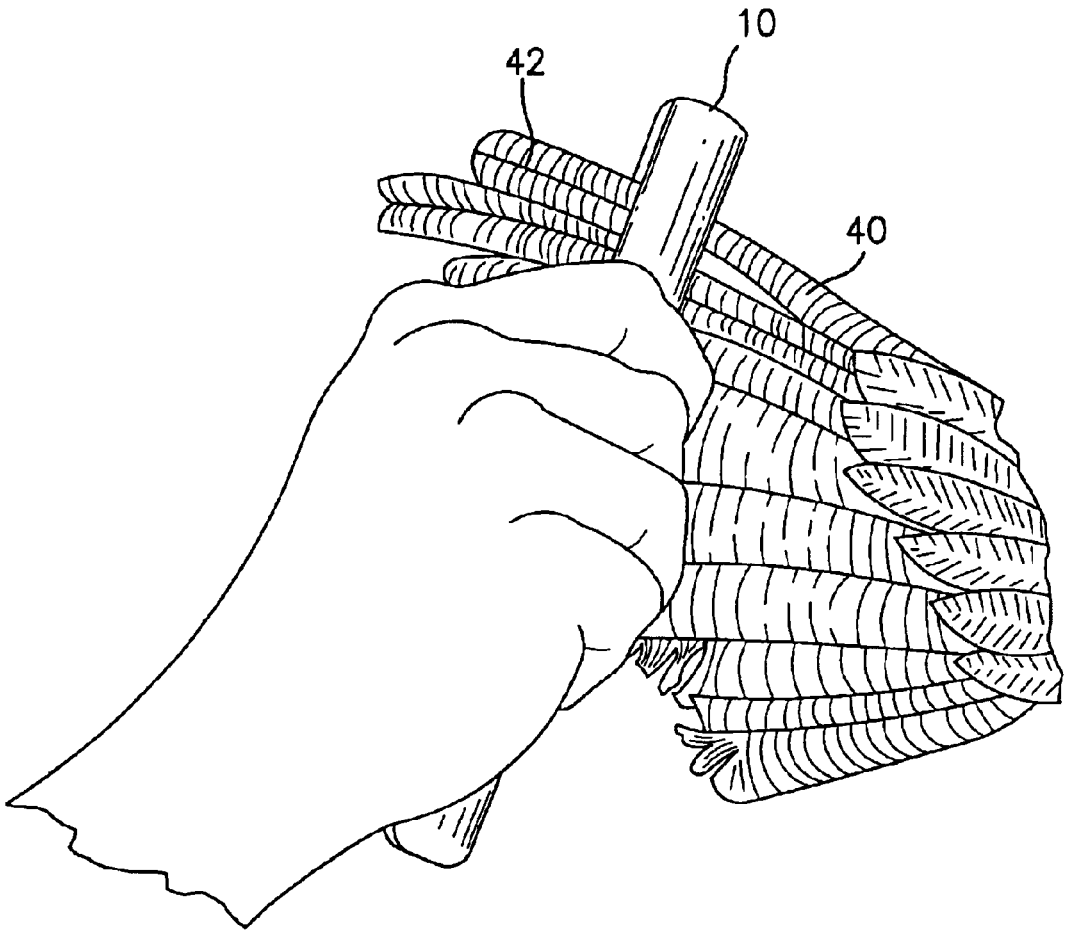
FIG. 5 is a perspective view of a feather to be curled positioned in the feather curler of the present invention.

Referring now to FIG. 5, a feather 40 to be curled is inserted into the space 32. The base member 12 and the mating member 14 are then manually squeezed together so that they contact the opposed surfaces of the feather. The curler 10 is then pulled along the length of the shaft 42 of the feather 40. The force which is applied breaks the spine of the shaft 42 and bends the feather.

The feathers 40 to be curled using the curler 10 may be curled while still on a bird to be displayed either before the bird is mounted to a support structure (not shown) or after the bird is mounted to the support structure.

The feather curler of the present invention has numerous advantages. First, it is simple to manufacture and relatively inexpensive to produce. Second, it is easy to use. Third, the curling operation does not require any heat application.

It is apparent that there has been provided in accordance with the present invention a feather curler which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A device for curling feathers comprising:

a base member having a convex surface;

a mating member having a concave surface;

said base member and said mating member defining a space between the convex surface and the concave surface into which a feather to be curled may be placed;

said base member and said mating member being configured so as to be squeezable so that said concave surface and said convex surface may be placed into contact with said feather to effect curling thereof;

means for joining the base member to said mating member to permit said members to be squeezed together; and said joining means comprising at least one threaded bore in said mating member, at least one aperture extending through said base member, and at least one threaded fastener for engaging said at least one threaded bore and for joining said base member to said mating member.

2. A device according to claim 1, wherein each of said base member and said mating member being formed from a plastic material.

3. A device according to claim 1, wherein said base member has a substantially planar base surface and said mating member has a concave shaped exterior surface.

4. A device for curling feathers comprising:

a base member having a convex surface;

a mating member having a concave surface;

said base member and said mating member defining a space between the convex surface and the concave surface into which a feather to be curled may be placed;

said base member and said mating member being configured so as to be squeezable so that said concave surface and said convex surface may be placed into contact with said feather to effect curling thereof; and said mating member having a first portion which extends along a first axis which is parallel to a longitudinal axis of said base member and a second portion which extends along a second axis at an angle to said first axis.

5. A device according to claim 4, further comprising means for joining the base member to said mating member to permit said members to be squeezed together.

6. A method for curling a feather comprising the steps of:

providing a curling device having a base member with a convex surface and a mating member with a concave surface;

inserting a feather into a space between said convex surface and said concave surface; and curling said feather by squeezing said base member and said mating member together so that said convex and concave surfaces contact said feather and breaking a spine of a feather shaft and bending said feather by pulling said curling device along the feather shaft.

7. A method according to claim 6, wherein said squeezing step is performed manually.

8. A method according to claim 6, wherein said base member and said mating member are in a non-heated condition during said squeezing and pulling steps.

9. A method according to claim 6, wherein said feather is on a bird and said curling step is performed prior to mounting the bird to a support structure.

10. A method according to claim 6, wherein said feather is on a bird and said curling step is performed after mounting of the bird to a support structure.

11. A method for curling a feather comprising the steps of:

providing a curling device comprising a base member having a convex surface extending along an entire length of said base member, a mating member having a concave surface extending along an entire length of said mating member, a first portion of said concave surface contacting said convex surface of said base member and being joined to said base member, and a second portion of said concave surface being spaced from the convex surface of the base member so as to define a space into which a feather to be curled may be placed;

inserting a feather into said space between said second portion of said concave surface and said convex surface; and curling said feather by squeezing said base member and said mating member together so that said convex and concave surfaces contact said feather and breaking a spine of the feather shaft and bending the feather by pulling said curling device along the shaft of said feather.

* * * * *